US010643469B2

(12) United States Patent
Li et al.

(10) Patent No.: US 10,643,469 B2
(45) Date of Patent: May 5, 2020

(54) TRAFFIC INTERSECTION DRIVING ASSISTANCE METHOD AND SYSTEM

(71) Applicants: ZHEJIANG GEELY AUTOMOBILE RESEARCH INSTITUTE CO., LTD, Taizhou (CN); ZHEJIANG GEELY HOLDING GROUP CO., LTD, Hangzhou (CN)

(72) Inventors: Xuefeng Li, Taizhou (CN); Ke Huo, Taizhou (CN); Bo Li, Taizhou (CN); Dayong Zhou, Taizhou (CN); Weiguo Liu, Taizhou (CN); Chengming Wu, Taizhou (CN); Qingfeng Feng, Taizhou (CN)

(73) Assignees: ZHEJIANG GEELY AUTOMOBILE RESEARCH INSTITUTE CO., LTD, Taizhou (CN); ZHEJIANG GEELY HOLDING GROUP CO., LTD., Hangzhou (CN)

( * ) Notice: Subject to any disclaimer, the term of this patent is extended or adjusted under 35 U.S.C. 154(b) by 0 days.

(21) Appl. No.: 15/575,593

(22) PCT Filed: May 20, 2016

(86) PCT No.: PCT/CN2016/082760
§ 371 (c)(1),
(2) Date: Dec. 12, 2017

(87) PCT Pub. No.: WO2016/184422
PCT Pub. Date: Nov. 24, 2016

(65) Prior Publication Data

US 2018/0158331 A1 Jun. 7, 2018

(30) Foreign Application Priority Data

May 20, 2015 (CN) ..... 2015 1 0260057

(51) Int. Cl.
*G08G 1/0968* (2006.01)
*G08G 1/0967* (2006.01)
*G08G 1/01* (2006.01)

(52) U.S. Cl.
CPC ..... *G08G 1/0968* (2013.01); *G08G 1/012* (2013.01); *G08G 1/0116* (2013.01);
(Continued)

(58) Field of Classification Search
None
See application file for complete search history.

(56) References Cited

U.S. PATENT DOCUMENTS 9,076,332 B2 * 7/2015 Myr ..... G08G 1/04
2003/0014181 A1 * 1/2003 Myr ..... G08G 1/0104 701/117

(Continued)

FOREIGN PATENT DOCUMENTS

CN 1472710 2/2004
CN 201845438 U 5/2011

(Continued)

OTHER PUBLICATIONS

International Search Report and Written Opinion of International Searching Authority for International Patent Application No. PCT/CN2016/082760 dated Jul. 26, 2016, with English translation, 19 pages.

*Primary Examiner* — Chico A Foxx
(74) *Attorney, Agent, or Firm* — Alston & Bird LLP

(57) ABSTRACT

The present invention provides a traffic intersection driving assistance method and system, wherein the method comprises: acquiring driving information about vehicles within a current intersection area by way of vehicle interconnection; obtaining vehicle flows in various driving directions according to the driving information; determining whether a (Continued)

difference in between vehicle flows in various driving directions exceeds a pre-set threshold, and if so, changing a driving direction of a variable lane; and sending information about the distribution of driving directions of current lanes to the vehicles within the current intersection area. The object of the present invention is to avoid traffic congestion by adjusting a variable lane in time.

8 Claims, 4 Drawing Sheets

(52) U.S. Cl.
CPC ..... *G08G 1/0133* (2013.01); *G08G 1/0145* (2013.01); *G08G 1/0967* (2013.01); *G08G 1/096775* (2013.01); *G08G 1/096783* (2013.01)

(56) References Cited

U.S. PATENT DOCUMENTS

2003/0060969 A1 3/2003 Waite et al.
2006/0155427 A1* 7/2006 Yang ..... G08G 1/07 701/1
2008/0094250 A1* 4/2008 Myr ..... G08G 1/04 340/909
2009/0167561 A1* 7/2009 Liang ..... G08G 1/0104 340/907
2009/0167562 A1* 7/2009 Liang ..... G08G 1/08 340/917
2011/0112746 A1* 5/2011 Takazawa ..... G01C 21/3626 701/117
2011/0261682 A1 10/2011 Han
2012/0253646 A1* 10/2012 Reghunath ..... G08G 1/0112 701/117
2013/0151135 A1* 6/2013 Aubrey ..... G08G 1/0116 701/118
2014/0266799 A1* 9/2014 Liu ..... G06Q 30/0259 340/928
2015/0154860 A1* 6/2015 Holzwanger ..... G08G 1/005 340/944
2015/0310737 A1* 10/2015 Simanowski ..... G08G 1/081 340/910
2016/0055745 A1* 2/2016 Karacan ..... G08G 1/163 701/117
2017/0268896 A1* 9/2017 Bai ..... G01C 21/3484
2018/0181091 A1* 6/2018 Funk ..... H04L 67/12

FOREIGN PATENT DOCUMENTS

CN 102157071 8/2011
CN 102867412 A 1/2013
CN 102867423 A 1/2013
CN 102968905 3/2013
CN 103208180 7/2013
CN 103208196 7/2013
CN 103258436 A 8/2013
CN 203204841 U 9/2013
CN 103366584 A 10/2013
CN 103426316 10/2013
CN 103700273 4/2014
CN 103854490 A 6/2014
CN 103884350 6/2014
CN 104036645 A 9/2014
CN 104933882 9/2015
GB 985214 A 3/1965
JP 2004013199 A 1/2004
JP 2007178359 A 7/2007
JP 2007179430 A 1/2009
JP 2010061335 A 3/2010
JP 2011145169 A 7/2011
WO WO-2011/126215 10/2011

* cited by examiner

TRAFFIC INTERSECTION DRIVING ASSISTANCE METHOD AND SYSTEM

CROSS-REFERENCE TO RELATED APPLICATIONS

This application is a national phase entry of International Application No. PCT/CN2016/082760, filed May 20, 2016, which claims priority to Chinese Patent Application No. 201510260057.X, filed on May 20, 2015, the entire contents of which are incorporated herein by reference.

TECHNICAL FIELD

The present invention relates to the field of car driving assistance, and particularly to a traffic intersection driving assistance method and system.

BACKGROUND OF THE INVENTION

At present, car ownership in China continues to rise, and as cars become common and popular, they facilitate the travel of residents, but at the same time bring about problems such as traffic congestion and frequent intersection traffic accidents.

In the prior art, in order to improve vehicle passing efficiency and relieve traffic pressure, video cameras or pinhole cameras are often installed on the roadside to take photographs or videos of vehicles coming and going, by means of which a driving condition on the road can be obtained. Then, the condition is transmitted to a data analysis centre for road data analysis and processing, and finally a driving direction of a variable lane is adjusted according to analysis results.

In the prior art, variable lanes are not adjusted in real time. Road information acquired by cameras or video cameras needs to be transmitted to data analysis centres, and information analysis precedes adjustments to variable lanes. Drivers cannot avoid congested roads and change lanes in advance by acquiring road conditions in real time, and while changing lanes, the drivers need to pay attention to the road conditions or look for road signs, which increases the burden of the drivers and affects driving comfortableness.

SUMMARY OF THE INVENTION

An object of the present invention is to provide a traffic intersection driving assistance method and system, so as to achieve the purpose of avoiding traffic congestion by adjusting a variable lane in time.

In order to achieve the purpose above, the present invention provides a traffic intersection driving assistance method, the method comprising:

acquiring driving information about vehicles within a current intersection area by way of vehicle interconnection;

obtaining vehicle flows in various driving directions according to the driving information;

determining whether a difference between the vehicle flows in various driving directions exceeds a pre-set threshold, and if so, changing a driving direction of a variable lane; and sending information about the distribution of driving directions of current lanes to the vehicles within the current intersection area.

Preferably, the method above further comprises:

obtaining a total flow of the current intersection area according to the driving information;

deriving congestion condition information about the current intersection area according to the total flow;

obtaining congestion condition information about a nearby intersection area by communicating with a nearby intersection, and sending the congestion condition information about the current intersection area and the congestion condition information about the nearby intersection area to the vehicles within the current intersection area.

Preferably, in the method above, the determining whether the difference between the vehicle flows in various driving directions exceeds a pre-set threshold specifically comprises:

calculating a difference between a vehicle flow in a first driving direction and that in a second driving direction; and determining whether the difference is greater than the pre-set threshold, and if so, keeping the driving direction of the variable lane consistent with a driving direction with a higher vehicle flow.

Preferably, the method above further comprises:

displaying in the vehicles the information about the distribution of the driving directions of the lanes, the congestion condition information about the current intersection area and the congestion condition information about the nearby intersection area.

Preferably, in the method above, the displaying is performed by means of a centre console screen or by way of image projection.

In order to better achieve the purpose above, the present invention also provides a traffic intersection driving assistance system, comprising:

an intersection facility interconnection unit, for acquiring driving information about vehicles within a current intersection area by way of vehicle interconnection;

a flow data analysis unit, for obtaining vehicle flows in various driving directions according to the driving information; and a variable lane driving direction change unit, for determining whether a difference between the vehicle flows in various driving directions exceeds a pre-set threshold, and if so, changing a driving direction of a variable lane;

wherein the intersection facility interconnection unit is further used for sending information about the distribution of driving directions of current lanes to the vehicles within the current intersection area.

Preferably, in the system above, the flow data analysis unit is further used for obtaining a total flow of the current intersection area according to the driving information, and deriving congestion condition information about the current intersection area according to the total flow; and the intersection facility interconnection unit is further used for obtaining congestion condition information about a nearby intersection area by communicating with a nearby intersection, and sending the congestion condition information about the current intersection area and the congestion condition information about the nearby intersection area to the vehicles within the current intersection area.

Preferably, in the system above, the variable lane driving direction change unit is specifically used for calculating a difference between a vehicle flow in a first driving direction and that in a second driving direction; and determining whether the difference is greater than the pre-set threshold, and if so, keeping the driving direction of the variable lane consistent with a driving direction with a higher vehicle flow.

Preferably, the system above further comprises:

an in-vehicle display unit, for displaying in the vehicles the information about the distribution of the driving directions of the lanes, the congestion condition information about the current intersection area and the congestion condition information about the nearby intersection area.

Preferably, in the system above, the in-vehicle display unit performs the displaying by means of a centre console screen or by way of image projection.

In the embodiment of the present invention, driving information about vehicles within an area is acquired using the vehicle interconnection technology, and based on information exchangeability and complete coverage of the vehicle interconnection technology, it can be ensured that as much vehicle driving information as possible can be acquired. On the basis of sufficiently comprehensive vehicle driving information, by acquiring vehicle flows in various driving directions according to the vehicle driving information, accurate vehicle flows in various driving directions within a current road area can be acquired, thus providing reliable data support for a subsequent adjustment to a variable lane. By adjusting a driving direction of a variable lane in real time according to vehicle flows, and by setting a threshold as a basis for determination, a rapid determination is made with a simple method, which can ensure that the variable lane can be adjusted in real time, thus achieving the purpose of avoiding traffic congestion by adjusting the variable lane in time. By informing vehicle owners within an intersection area of information about driving directions of a current road, the drivers are enabled to learn about a driving direction condition of the current road, thus helping the drivers avoid a congested road, acquire an optimum route to their destinations and finally achieve a comfortable and safe driving experience. Therefore, by applying the method and apparatus according to the embodiments of the present invention, not only can the purpose of avoiding traffic congestion be achieved by adjusting a variable lane in time, but also drivers can be provided with driving assistance and route guidance for them to arrive at destinations rapidly, and they can avoid congested roads in time, thus improving driving comfortableness.

According to the detailed description of specific embodiments of the present invention below in conjunction with the accompanying drawings, the above and other purposes, advantages and features of the present invention will become clearer to a person skilled in the art.

BRIEF DESCRIPTION OF THE DRAWINGS

Some of specific embodiments of the present invention will be described below in detail with reference to the accompanying drawings by way of example but not by way of limitation. The same reference signs indicate the same or similar components or parts in the accompanying drawings. It is understood by a person skilled in the art that the drawings are not necessarily drawn to scale. In the drawings.

DETAILED DESCRIPTION OF THE INVENTION

Figure 1:
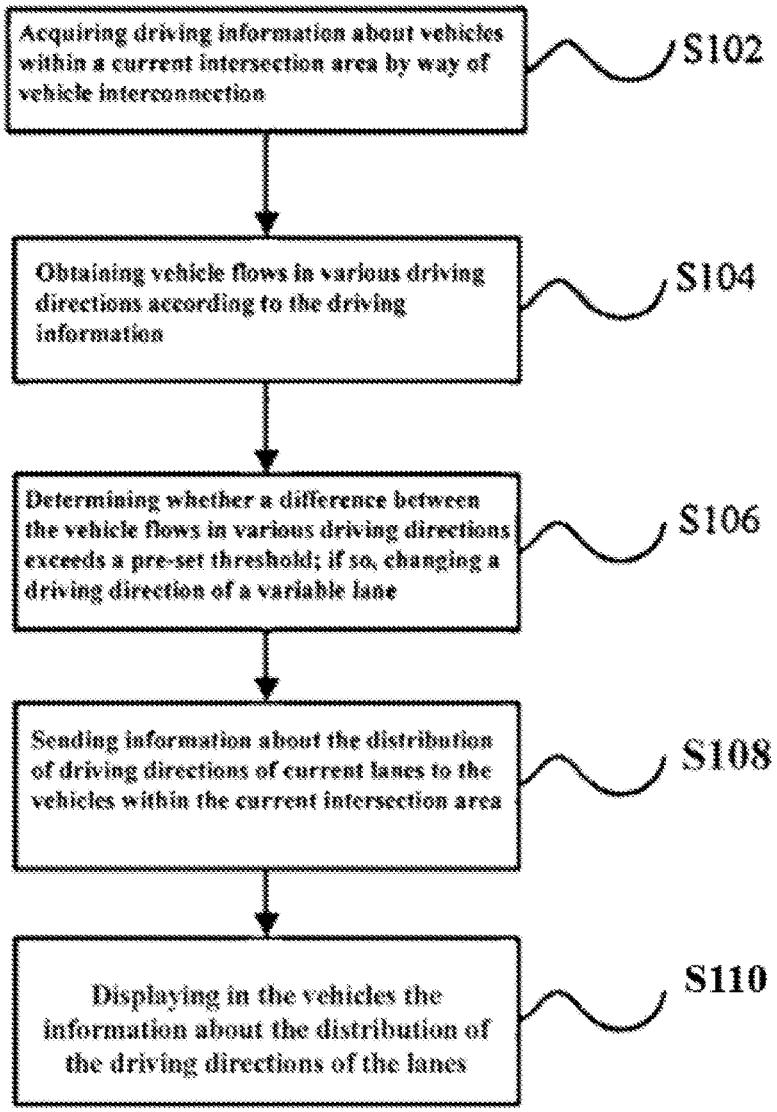
FIG. 1 is a flow chart of steps of a traffic intersection driving assistance method according to an embodiment of the present invention.

FIG. 1 is a flow chart of steps of a traffic intersection driving assistance method according to an embodiment of the present invention. As shown in FIG. 1, an embodiment of the present invention provides a traffic intersection driving assistance method, the method comprising at least steps S102-S110.

In step S102, driving information about vehicles within a current intersection area is acquired by way of vehicle interconnection.

In step S104, vehicle flows in various driving directions are obtained according to the driving information.

In step S106, a determination is made regarding whether a difference between the vehicle flows in various driving directions exceeds a pre-set threshold, and if so, a driving direction of a variable lane is kept consistent with a driving direction with a higher vehicle flow.

In step S108, information about the distribution of driving directions of current lanes is sent to the vehicles within the current intersection area.

In step S110, displaying in the vehicles the information about the distribution of the driving directions of the lanes.

In the embodiment of the present invention, driving information about vehicles within an area is acquired using the vehicle interconnection technology, and based on information exchangeability and complete coverage of the vehicle interconnection technology, it can be ensured that as much vehicle driving information as possible can be acquired. On the basis of sufficiently comprehensive vehicle driving information, by acquiring vehicle flows in various driving directions according to the vehicle driving information, accurate vehicle flows in various driving directions within a current road area can be acquired, thus providing reliable data support for a subsequent adjustment to a variable lane. By adjusting a driving direction of a variable lane in real time according to vehicle flows, and by setting a threshold as a basis for determination, a rapid determination is made with a simple method, which can ensure that the variable lane can be adjusted in real time, thus achieving the purpose of avoiding traffic congestion by adjusting the variable lane in time. By informing vehicle owners within an intersection area of information about driving directions of a current road, the drivers are enabled to learn about a driving direction condition of the current road, thus helping the drivers avoid a congested road, acquire an optimum route to their destinations and finally achieve a comfortable and safe driving experience. Therefore, by applying the method according to the embodiment of the present invention, not only can the purpose of avoiding traffic congestion be achieved by adjusting a variable lane in time, but also drivers can be provided with driving assistance and route guidance for them to arrive at destinations rapidly, and they can avoid congested roads in time, thus improving driving comfortableness.

In step S102, the vehicle interconnection technology is vehicle communication technology which is able to connect the vehicles within the area to the same local area network, thereby achieving information communication and sharing between the vehicles. Utilizing the vehicle interconnection technology for information communication and sharing has the characteristics of rapid information transfer, complete vehicle coverage and real-time information acquisition.

In step S102, the driving information about the vehicles comprises information describing operation conditions of the vehicles, such as driving direction, driving speed and distance to front and/or rear vehicles. When necessary, information about the vehicles such as acceleration and braking deceleration should also be part of the driving information.

Here, a method for acquiring vehicle driving information by the vehicle interconnection technology is schematically provided. An application program with the vehicle interconnection technology may be installed in the vehicles, or the application program with the vehicle interconnection technology may be arranged on the main control panel of the vehicles, and the program automatically runs when it is necessary to acquire driving information about the vehicles, so as to automatically acquire operation information without causing disturbance to drivers who are driving.

Further, a communication apparatus having vehicle interconnection functions may also be separately arranged. It may be placed anywhere in the vehicle by the driver, preferably in an armrest box, and may be controlled through Bluetooth or a wireless network. When it is necessary to acquire the driving information about the vehicle, control can be performed using a control program on a mobile phone or a control program in the vehicle so as to acquire the driving information about the vehicle in time.

In step S104, the vehicle flows in various driving directions can be acquired according to the driving information, particularly vehicle running directions in the driving information. The calculated vehicle flows may be a sum of the number of vehicles in the same driving direction, and may also be data obtained by means of a specific algorithm based on information such as an operation speed of a vehicle and a distance between the vehicle and a front vehicle. For ease of illustration, a vehicle flow in a certain driving direction is preferably equal to a sum of the number of vehicles moving in the direction.

For example, in the case that an operation direction of a vehicle at an intersection of a certain road comprises turn left and go straight forward, the sum of the number of left turn vehicles is the vehicle flow of the road for left turn vehicles, and by the same reasoning, the sum of the number of through vehicles is the vehicle flow for through vehicles.

In the embodiment of the present invention, in order to acquire the vehicle flows in various driving directions in real time, the driving directions of various vehicles must be learnt about in real time, and therefore, the driving information about the vehicles must be known in real time, which needs can be satisfied using the vehicle interconnection technology which provides real-time information acquisition and transfer.

In step S106, the determination regarding whether to change the driving direction of the variable lane is made according to whether the difference between the vehicle flows in various driving directions exceeds the pre-set threshold.

Figure 2:
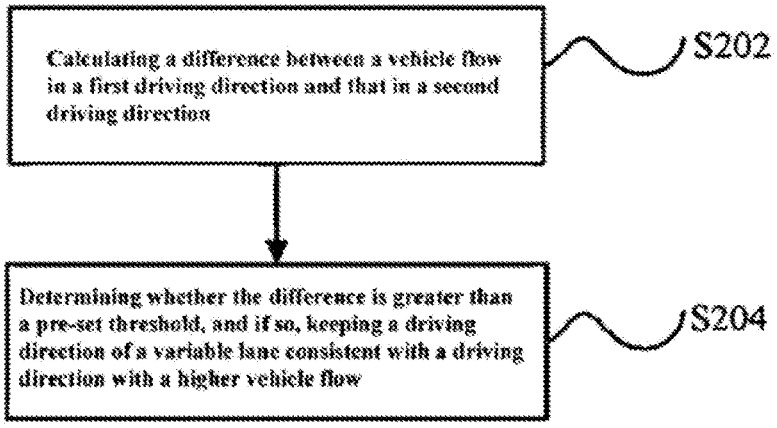
FIG. 2 is a flow chart of steps of a method for changing a lane based on a vehicle flow according to an embodiment of the present invention.

Further, FIG. 2 is a flow chart of steps of a method for changing a lane according to a vehicle flow according to an embodiment of the present invention. As shown in FIG. 2, a method for changing a lane according to a vehicle flow is provided here, the method specifically comprising:

in step S202, a difference between a vehicle flow in a first driving direction and that in a second driving direction is calculated; and in step S204, a determination is made regarding whether the difference is greater than a pre-set threshold, and if so, a driving direction of a variable lane is kept consistent with a driving direction with a higher vehicle flow.

The driving direction of the variable lane here means that at an intersection where the lanes are for driving in the same direction, the driving direction is divided into a left turn lane, a through lane and a right turn lane. When vehicles at the intersection enter corresponding turn lanes, an intersection device will determine which driving direction has more vehicles, and whether the number of the vehicles exceeds a threshold, and if so, the variable lane is changed to a lane with the corresponding turn direction. For example, when there are a lot of left turn vehicles at the intersection, a lot of vehicles will queue up in the left turn lane at the intersection. If this is significantly different from the queue-up situation in the through lane, and the difference exceeds a threshold, in order to improve the passing rate of the left turn lane and avoid congestion, the variable lane at the intersection is changed from the original through lane to a left turn lane. When the number of vehicles queuing up in the through lane is larger than that in the left turn lane and the difference exceeds a certain threshold, the variable lane is changed from the original left turn lane to a through lane.

A vehicle which has chosen and entered a lane with a driving direction at the intersection is not allowed to change the lane at will, and therefore, it is necessary to provide a driver who intends to enter the intersection with an image prompt or a projected prompt so as to help the driver drive to a correct turn lane he/she desires.

By sending the current information about the distribution of the driving directions of the lanes to the vehicles within the current intersection area in step 108, the vehicles within the intersection area can learn about the driving situation of the road, thus helping the drivers avoid a congested road by choosing an optimum driving route.

The information about the distribution of the driving directions of the lanes comprises at least the vehicle flows in various driving directions on the current road, and can also comprise a lane change situation of a variable lane, so as to provide real-time and reliable information for a driver to choose an optimum driving route.

Figure 3:
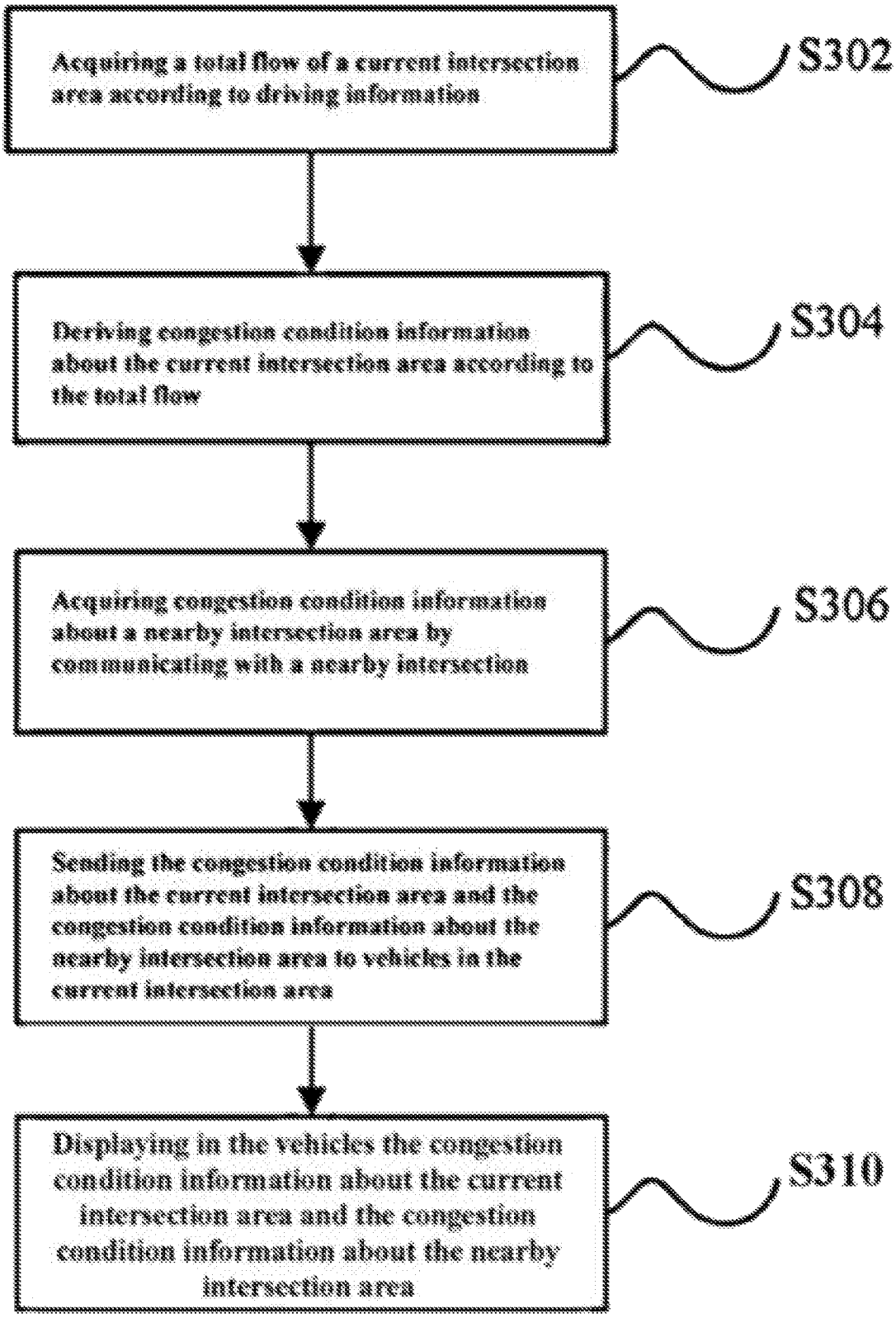
FIG. 3 is a flow chart of steps of a method for displaying a road congestion condition according to an embodiment of the present invention.

To further assist driving and improve driving and riding experience, here is also provided a method for displaying a road congestion condition. FIG. 3 is a flow chart of steps of a method for displaying a road congestion condition according to an embodiment of the present invention. As shown in FIG. 3, the method comprising at least steps S302-S310.

In step S302, a total flow of a current intersection area is acquired according to driving information.

In step S304, congestion condition information about the current intersection area is derived according to the total flow.

In step S306, congestion condition information about a nearby intersection area is acquired by communicating with a nearby intersection.

In step S308, the congestion condition information about the current intersection area and the congestion condition information about the nearby intersection area are sent to vehicles in the current intersection area.

In step S310, displaying in the vehicles the congestion condition information about the current intersection area and the congestion condition information about the nearby intersection area.

In step S302, in order to acquire the total flow in the area, a preferred approach is getting a total number of all operating vehicles, and it may also be another calculating approach based on a specific algorithm which combines information about the vehicles such as operation direction and operation speed.

In step S304, the congestion condition of the intersection area is obtained according to the total flow. The larger a total number of vehicles operating in a certain intersection area, the more congested an area nearby the intersection will be.

In step S306, by combining congestion information about the nearby intersection area, drivers can be provided with comprehensive road information, so that the drivers can be prevented from choosing a nearby congested road.

In step S308, by sending the congestion condition information about the current intersection area and the congestion condition information about the nearby intersection area to the vehicles within the current intersection area, drivers can be enabled to learn about the congestion condition of a current road and a nearby road, thus helping the drivers seek an optimum route.

It is clear from the above that by acquiring a congestion condition of a current intersection area and a congestion condition of a nearby intersection area and informing vehicles within the current intersection area of these congestion conditions in time, it can ensured that drivers in the current intersection area learn about the congestion conditions of the current road section and nearby road sections in time and thus have clear knowledge of traffic information about nearby areas, provide reliable information for the drivers to choose a road, and assist the drivers in acquiring an optimum driving route in time.

In summary, by acquiring driving information about a vehicle by the vehicle interconnection technology and obtaining vehicle flows in various driving directions, and by determining whether to change a lane direction according to a difference between the vehicle flows in various driving directions and a pre-set threshold, a driving direction can be changed according to a real-time road condition so as to relieve traffic pressure in time and avoid traffic congestion. By sending information about the distribution of vehicles on a current road to vehicles within an intersection area, drivers can be assisted in choosing an optimum driving route, thus ensuring that a congested road is avoided.

Moreover, to make it convenient for the drivers to learn about road information, the following information can be displayed in the vehicle: information about the distribution of driving directions of lanes, congestion condition information about a current intersection area and congestion condition information about a nearby intersection area.

Further, the information can be displayed by means of a centre console screen or by way of image projection, or in combination with a voice prompt, so as to inform the drivers without affecting driving.

For example, a relatively small screen, which does not affect driving, can be arranged in a driver area for displaying the following information: information about the distribution of driving directions of lanes, congestion condition information about a current intersection area and congestion condition information about a nearby intersection area. The information about the distribution of driving directions of lanes can be displayed by means of an image based on a road model, and the driving directions of the lanes are displayed by arrow directions.

Figure 4:
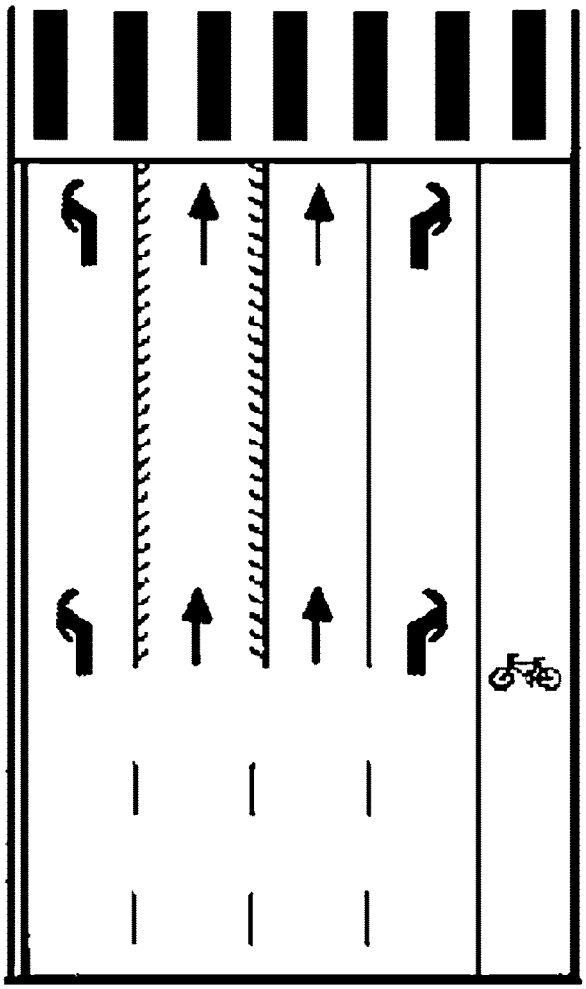
FIG. 4 is a schematic diagram of information about the distribution of driving directions of lanes according to an embodiment of the present invention.

FIG. 4 is a schematic diagram of information about the distribution of driving directions of lanes according to an embodiment of the present invention. It is clear from FIG. 4 that driving directions of various lanes are represented by arrow directions. After being informed of information about the driving directions of the lanes, drivers can choose a suitable driving route and obtain an optimum travel plan as early as possible.

When congestion condition information is displayed by an image, on the basis of displaying a road model, congestion conditions can be represented using colours, for example, red represents a seriously congested area, and green represents an expedite driving area.

Figure 5:
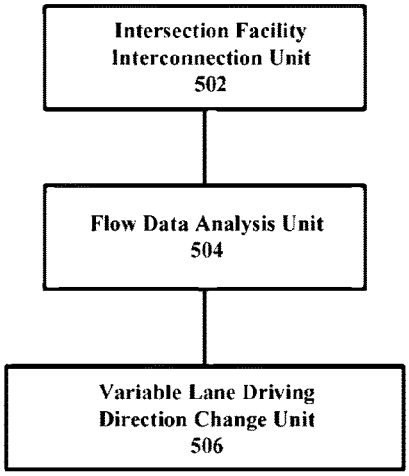
FIG. 5 is a structural schematic diagram of a traffic intersection driving assistance system according to an embodiment of the present invention.

To further illustrate the traffic intersection driving assistance method as provided in FIG. 1, reference is made to FIG. 5. Another embodiment of the present invention further provides a traffic intersection driving assistance system, the system comprising at least an intersection facility interconnection unit 502, a flow data analysis unit 504 and a variable lane driving direction change unit 506, with connection relationships and functions of these units specifically shown as follows:

the intersection facility interconnection unit 502 is used for acquiring driving information about vehicles within a current intersection area by way of vehicle interconnection;

the flow data analysis unit 504 is used for obtaining vehicle flows in various driving directions according to the driving information; and the variable lane driving direction change unit 506 is used for determining whether a difference between the vehicle flows in various driving directions exceeds a pre-set threshold, and if so, changing a driving direction of a variable lane.

The intersection facility interconnection unit 502 is further used for sending information about the distribution of driving directions of current lanes to the vehicles within the current intersection area.

In the embodiment of the present invention, in the intersection facility interconnection unit 502, driving information about vehicles within an area is acquired using the vehicle interconnection technology, and based on information exchangeability and complete coverage of the vehicle interconnection technology, it can be ensured that as much vehicle driving information as possible can be acquired. On the basis of sufficiently comprehensive vehicle driving information, by using the flow data analysis unit 504, by acquiring vehicle flows in various driving directions according to the vehicle driving information, accurate vehicle flows in various driving directions within a current road area can be acquired, thus providing reliable data support for a subsequent adjustment to a variable lane. By adjusting, by the variable lane driving direction change unit 506, a driving direction of a variable lane in real time according to vehicle flows, and by setting a threshold as a basis for determination, a rapid determination is made with a simple method, which can ensure that the variable lane can be adjusted in real time, thus achieving the purpose of avoiding traffic congestion by adjusting the variable lane in time. The intersection facility interconnection unit 502 can also inform vehicle owners within an intersection area of information about driving directions of a current road, and can enable the drivers to learn about a driving direction condition of the current road, thus helping the drivers avoid a congested road, acquire an optimum route to their destinations and finally achieve a comfortable and safe driving experience. Therefore, by applying the apparatus according to the embodiment of the present invention, not only can the purpose of avoiding traffic congestion be achieved by adjusting a variable lane in time, but also drivers can be provided with driving assistance and route guidance for them to arrive at destinations rapidly, and they can avoid congested roads in time, thus improving driving comfortableness.

In the intersection facility interconnection unit 502, the driving information about the vehicles comprises information describing operation conditions of the vehicles, such as driving directions, driving speeds and distances to front and/or rear vehicles. When necessary, information about the vehicles such as acceleration and braking deceleration should also be part of the driving information.

Here, a method for acquiring vehicle driving information by the vehicle interconnection technology is schematically provided. An application program with the vehicle interconnection technology may be installed in the vehicles, or the application program with the vehicle interconnection technology may be arranged on the main control panel of the vehicles, and the program automatically runs when it is necessary to acquire driving information about the vehicles, so as to automatically acquire operation information without causing disturbance to drivers who are driving.

Further, a communication apparatus having vehicle interconnection functions may also be separately arranged. It may be placed anywhere in the vehicle by the driver, preferably in an armrest box, and may be controlled through Bluetooth or a wireless network. When it is necessary to acquire the driving information about the vehicle, control can be performed using a control program on a mobile phone or a control program in the vehicle so as to acquire the driving information about the vehicle in time.

In the flow data analysis unit 504, the vehicle flows in various driving directions can be acquired according to the driving information, particularly vehicle running directions in the driving information. The calculated vehicle flows may be a sum of the number of vehicles in the same driving direction, and may also be data obtained by means of a specific algorithm based on information such as an operation speed of a vehicle and a distance between the vehicle and a front vehicle. For ease of illustration, a vehicle flow in a certain driving direction is preferably equal to a sum of the number of vehicles moving in the direction.

For example, in the case that an operation direction of a vehicle on a certain road comprises left turn and through, the sum of the number of left turn vehicles is the vehicle flow of the road for left turn vehicles, and by the same reasoning, the sum of the number of through vehicles is the vehicle flow for through vehicles.

In the embodiment of the present invention, in order to acquire the vehicle flows in various driving directions in real time, the driving directions of various vehicles must be learnt about in real time, and therefore, the driving information about the vehicles must be known in real time, which needs can be satisfied using the vehicle interconnection technology which provides real-time information acquisition and transfer.

In the embodiment of the present invention, the variable lane driving direction change unit 506 is used for determining whether a difference between the vehicle flows in various driving directions exceeds a pre-set threshold, and if so, changing a driving direction of a variable lane. Further, the variable lane driving direction change unit 506 is specifically used for calculating a difference between a vehicle flow in a first driving direction and that in a second driving direction; and determining whether the difference is greater than the pre-set threshold, and if so, keeping the driving direction of the variable lane consistent with a driving direction with a higher vehicle flow.

For a variable lane, whether to change a driving direction of the lane can be determined by setting a threshold. Particularly, a difference in the vehicle flows in various driving directions can be calculated, and if the difference exceeds the pre-set threshold, the direction of the variable lane is changed.

In the embodiment of the present invention, the intersection facility interconnection unit 502 is also used for sending information about the distribution of driving directions of current lanes to the vehicles within the current intersection area. By sending the information about the distribution of the driving directions of the current lanes to the vehicles within the current intersection area, the vehicles within the intersection area can learn about the driving situation of the road in time, thus helping the drivers avoid a congested road by choosing an optimum driving route.

The information about the distribution of the driving directions of the lanes comprises at least the vehicle flows in various driving directions on the current road, and can also comprise a driving direction of a variable road, for example, when a vehicle approaches an intersection, the number of left turn, through and right turn vehicles at the intersection ahead, as well as the driving direction of the variable lane at the intersection are acquired, so that drivers can learn about the road condition before arriving at the intersection, thereby providing real-time and reliable information for the drivers to choose an optimum driving route.

In another embodiment of the present invention, the flow data analysis unit 504 is also used for obtaining a total flow of the current intersection area according to the driving information; and deriving congestion condition information about the current intersection area according to the total flow. The intersection facility interconnection unit 502 is further used for obtaining congestion condition information about a nearby intersection area by communicating with a nearby intersection, and sending the congestion condition information about the current intersection area and the congestion condition information about the nearby intersection area to the vehicles within the current intersection area.

By acquiring a congestion condition of a current intersection area and a congestion condition of a nearby intersection area and informing vehicles within the current intersection area of these congestion conditions in time, it can ensured that drivers in the current intersection area learn about the congestion conditions of the current road section and nearby road sections in time and thus have clear knowledge of traffic information about nearby areas, provide reliable information for the drivers to choose a road, and assist the drivers in acquiring an optimum driving route in time.

The embodiment of the present invention also comprises an in-vehicle display unit (not shown in FIG. 5) for displaying in the vehicles the information about the distribution of the driving directions of the lanes, the congestion condition information about the current intersection area and the congestion condition information about the nearby intersection area.

Further, the in-vehicle display unit performs the displaying by means of a centre console screen or by way of image projection.

It is understood by a person skilled in the art that the working principle of the traffic intersection driving assistance system in FIG. 5 complies with the descriptions of FIGS. 1-4 and respective embodiments and will not be described further.

Figure 6:
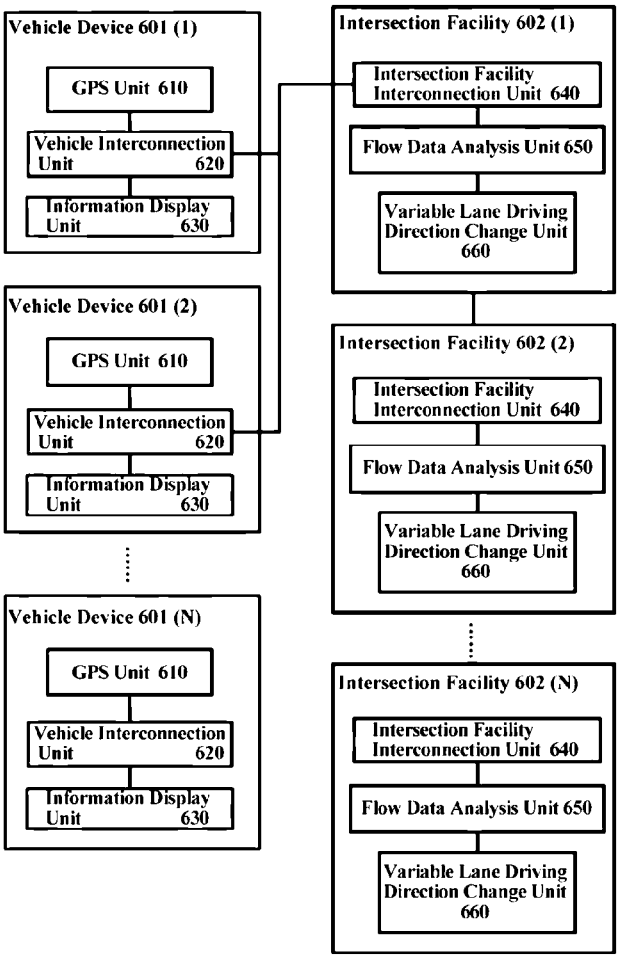
FIG. 6 is a structural schematic diagram of a traffic intersection driving assistance system according to an embodiment of the present invention.

FIG. 6 is a structural schematic diagram of a traffic intersection driving assistance system according to an embodiment of the present invention. As shown in FIG. 6, the embodiment of the present invention further provides a traffic intersection driving assistance system, the system comprising a vehicle device 601 and an intersection facility 602, wherein a plurality of vehicle devices 601 are provided, one for each vehicle, and a plurality of intersection facilities 602 are provided as well, one for each intersection. The vehicle device 601 comprises a GPS (Global Positioning System) unit 610, a vehicle interconnection unit 620 and an information display unit 630; and the intersection facility 602 comprises an intersection facility interconnection unit 640, a flow data analysis unit 650 and a variable lane driving direction change unit 660.

Specifically, the working principle of the vehicle device 601 is as follows: when a vehicle drives on a road and starts driving to an intersection, the vehicle device 601 starts communicating with the intersection device 602. The GPS unit 610 in the vehicle device 601 can acquire an accurate position of the vehicle, and can send, by the vehicle interconnection unit 620, the position to the intersection facility 602 at the intersection; the vehicle device 601 receives information about the distribution of driving directions of lanes and congestion condition information about a nearby intersection sent from the intersection facility 602; the information about the distribution of the driving directions of the lanes and the congestion condition information about the nearby intersection can be displayed in the vehicle by the information display unit 630 by means of a centre console screen or by way of image projection and the like, thus assisting the driver in choosing a needed lane to avoid a congested intersection, thereby optimizing the driving route.

As shown in FIG. 6, all vehicles with the vehicle device 601(1) and the vehicle device 601(2) drive towards the intersection where the intersection facility 602(1) is located, and therefore the vehicle device 601(1) and the vehicle device 601(2) communicate with the intersection facility 602(1). The vehicle device 601, except the vehicle device 601(1) and the vehicle device 601(2), does not communicate with the intersection facility 602(1), and other intersection facilities 602, except the intersection facility 602(1), do not participate in the communication.

The working principle of the intersection facility 602 is as follows: the intersection facility interconnection unit 640 in the intersection facility 602 receives the position information sent from vehicles driving to and passing the intersection, and the data can be analyzed by the flow data analysis unit 650 to acquire the flow at the intersection and the vehicle flows in various driving directions and determine whether a difference in the vehicle flows in various directions exceeds a pre-set threshold; if so, the variable lane driving direction change unit 660 is utilized to change the driving direction of the variable lane, and if not, no change is made. The plurality of intersection facilities 602 can communicate with each other, exchange congestion information about respective intersections, and send, by the interconnection unit 620, the information about the distribution of the driving directions of the current lanes and the congestion conditions of nearby areas to the vehicles.

It is understood by a person skilled in the art that the working principle of the traffic intersection driving assistance system in FIG. 6 complies with the descriptions of FIGS. 1-5 and respective embodiments and will not be described further.

In conjunction with the embodiments of FIGS. 1-6, in the embodiments of the present invention, driving information about vehicles within an area is acquired using the vehicle interconnection technology, and based on information exchangeability and complete coverage of the vehicle interconnection technology, it can be ensured that as much vehicle driving information as possible can be acquired. On the basis of sufficiently comprehensive vehicle driving information, by acquiring vehicle flows in various driving directions according to the vehicle driving information, accurate vehicle flows in various driving directions within a current road area can be acquired, thus providing reliable data support for a subsequent adjustment to a variable lane. By adjusting a driving direction of a variable lane in real time according to vehicle flows, and by setting a threshold as a basis for determination, a rapid determination is made with a simple method, which can ensure that the variable lane can be adjusted in real time, thus achieving the purpose of avoiding traffic congestion by adjusting the variable lane in time. By informing vehicle owners within an intersection area of information about driving directions of a current road, the drivers are enabled to learn about a driving direction condition of the current road, thus helping the drivers avoid a congested road, acquire an optimum route to their destinations and finally achieve a comfortable and safe driving experience. Therefore, by applying the method and apparatus according to the embodiments of the present invention, not only can the purpose of avoiding traffic congestion be achieved by adjusting a variable lane in time, but also drivers can be provided with driving assistance and route guidance for them to arrive at destinations rapidly, and they can avoid congested roads in time, thus improving driving comfortableness.

Various component embodiments of the present invention can be implemented in hardware, or implemented in a software module running on one or more processors, or implemented in a combination thereof. It is understood by a person skilled in the art that in practice, some or all of the functions of some or all of the components or modules in the apparatus of the embodiments of the present invention can be implemented using a microprocessor or a digital signal processor (DSP). The present invention may also be implemented as a device or apparatus program (for example, a computer program or a computer program product) for executing part or all of the method described herein. Such a program for implementing the present invention can be stored on a computer readable medium, or has a form of one or more signals. Such signals can be downloaded from websites on the Internet, or provided on a carrier signal, or provided in any other form.

To this end, it is recognized by a person skilled in the art that although multiple exemplary embodiments of the present invention have been shown and described in detail herein, many other variations or modifications complying with the principles of the present invention can be directly determined or derived from the contents disclosed in the present invention without departing from the spirit and scope of the present invention. Therefore, the scope of the present invention should be construed and deemed as encompassing all these and other variations or modifications.

What is claimed is:

1. A traffic intersection driving assistance method, characterized in that the method comprises:

acquiring driving information about vehicles within a current intersection area by way of vehicle interconnection;

obtaining vehicle flows in various driving directions on a current road according to the driving information;

calculating a difference between a vehicle flow in a first driving direction on the current road and that in a second driving direction on the current road;

determining whether the difference is greater than a pre-set threshold;

sending information about a distribution of driving directions of current lanes on the current road to the vehicles within the current intersection area, wherein the current road leads to the current intersection and comprises a lane with the first driving direction, a lane with the second driving direction, and a variable lane;

wherein when the difference is greater than the pre-set threshold, the driving direction of the variable lane is the second driving direction, and the vehicle flow in the first driving direction on the current road is greater than the vehicle flow in the second driving direction on the current road, the driving direction of the variable lane at the current intersection is changed to the first driving direction; and wherein when the difference is greater than the pre-set threshold, the driving direction of the variable lane is the first driving direction, and the vehicle flow in the second driving direction on the current road is greater than the vehicle flow in the first driving direction on the current road, the driving direction of the variable lane at the current intersection is changed to the second driving direction.

2. The method according to claim 1, characterized in that the method further comprises:

obtaining a total flow of the current intersection area according to the driving information;

deriving congestion condition information about the current intersection area according to the total flow;

obtaining congestion condition information about a nearby intersection area by communicating with a nearby intersection; and sending the congestion condition information about the current intersection area and the congestion condition information about the nearby intersection area to the vehicles within the current intersection area.

3. The method according to claim 2, characterized in that the method further comprises:

displaying in the vehicles the information about the distribution of the driving directions of the lanes, the congestion condition information about the current intersection area and the congestion condition information about the nearby intersection area.

4. The method according to claim 3, characterized in that the displaying is performed by means of a centre console screen or by way of image projection.

5. A traffic intersection driving assistance system, characterized in that the system comprises:

an intersection facility interconnection unit, for acquiring driving information about vehicles within a current intersection area by way of vehicle interconnection;

a flow data analysis unit, for obtaining vehicle flows in various driving directions on a current road according to the driving information;

a variable lane driving direction change unit, for calculating a difference between a vehicle flow in a first driving direction on the current road and that in a second driving direction on the current road;

the variable lane driving direction change unit, is further used for determining whether the difference is greater than a pre-set threshold;

wherein the intersection facility interconnection unit is further used for sending information about a distribution of driving directions of current lanes on the current road to the vehicles within the current intersection area;

wherein the current road leads to the current intersection and comprises a lane with the first driving direction, a lane with the second driving direction, and a variable lane;

wherein when the difference is greater than the pre-set threshold, the driving direction of the variable lane is the second driving direction, and the vehicle flow in the first driving direction on the current road is greater than the vehicle flow in the second driving direction on the current road, the driving direction of the variable lane at the current intersection is changed to the first driving direction; and wherein when the difference is greater than the pre-set threshold, the driving direction of the variable lane is the first driving direction, and the vehicle flow in the second driving direction on the current road is greater than the vehicle flow in the first driving direction on the current road, the driving direction of the variable lane at the current intersection is changed to the second driving direction.

6. The system according to claim 5, characterized in that the flow data analysis unit is further used for obtaining a total flow of the current intersection area according to the driving information, and deriving congestion condition information about the current intersection area according to the total flow; and the intersection facility interconnection unit is further used for obtaining congestion condition information about a nearby intersection area by communicating with a nearby intersection, and sending the congestion condition information about the current intersection area and the congestion condition information about the nearby intersection area to the vehicles within the current intersection area.

7. The system according to claim 6, characterized in that the system further comprises:

an information display unit, for displaying in the vehicles the information about the distribution of the driving directions of the lanes, the congestion condition information about the current intersection area and the congestion condition information about the nearby intersection area.

8. The system according to claim 7, characterized in that the information display unit performs the displaying by means of a centre console screen or by way of image projection.

* * * * *